US005674824A

United States Patent [19]

Eschette

[11] Patent Number: 5,674,824

[45] Date of Patent: Oct. 7, 1997

[54] METHOD OF FORMING A BAR OF SOAP

[76] Inventor: Lola T. B. Eschette, 8968 Hwy. 1, Lot 1, Lockport, La. 70374

[21] Appl. No.: 556,378

[22] Filed: Nov. 13, 1995

[51] Int. Cl.[6] ..... C11D 17/00

[52] U.S. Cl. ..... 510/141; 510/143; 510/152; 510/440; 510/446

[58] Field of Search ..... 510/141, 143, 510/152, 440, 446

[56] References Cited

U.S. PATENT DOCUMENTS

| | | | |
|---|---|---|---|
| 108,584 | 10/1870 | George | 510/143 |
| 3,746,647 | 7/1973 | Peloquin | 510/440 |
| 4,308,157 | 12/1981 | Di Giovanna | 252/92 |
| 4,402,284 | 9/1983 | Brewer | 252/134 |
| 4,965,008 | 10/1990 | Chang | 252/134 |
| 5,198,140 | 3/1993 | Joshi et al. | 252/90 |

*Primary Examiner*—Jacqueline V. Howard
*Attorney, Agent, or Firm*—Joseph N. Breaux

[57] ABSTRACT a method of forming a bar of soap from a plurality of soap bar slivers including the steps of: providing a cementing agent including a mixture containing powdered bar soap and powdered talcum in proportions equal to between two-to-one and ten-to-one powdered bar soap to powdered talcum that has been mixed with sufficient water to form a paste; and utilizing the cementing agent to cement the soap slivers into an agglomeration bar.

2 Claims, No Drawings

METHOD OF FORMING A BAR OF SOAP

TECHNICAL FIELD

The present invention relates to methods of producing bars of soap and more particularly to a method of producing bars of soap from left over soap portions of other bars of soap by securing the scrap portions together with a cementing agent.

BACKGROUND ART

Bar soap is utilized in most homes for bathing and showering purposes. These bars decrease in size through use until only a sliver sized portion remains. These sliver sized portions are difficult to use and, therefore, are often discarded. It would be a benefit therefore to have a method of joining a quantity of the sliver portions into a single bar of a size sufficient for convenient utilization while showering or bathing. It would be a further benefit if the method did not require the use of a special holding vessel or press. It would be a still further benefit if the method were easily learned and practiced successfully with a minimum of training. It would be a still further benefit if the method allowed the individual slivers to be secured together with an adhesive or cementing compound that did not interfere with or restrict the use of the finished bar of soap formed by practicing the method.

GENERAL SUMMARY DISCUSSION OF INVENTION

It is thus an object of the invention to provide a method of forming a bar of soap from a plurality of soap bar slivers.

It is a further object of the invention to provide a method for forming a bar of soap that does not require the use of a special holding vessel or press.

It is a further object of the invention to provide a method of forming a bar of soap that is easily learned and practiced successfully with a minimum of training.

It is a still further object of the invention to provide a method of forming a bar of soap wherein individual slivers of bar soap are secured together with an adhesive or cementing compound that does not interfere with or restrict the use of a finished bar of soap formed by practicing the method.

It is a still further object of the invention to provide a method of forming a bar of soap that accomplishes all or some of the above objects in combination.

Accordingly, a method of forming a bar of soap is provided. The method includes the steps of: 1) providing a plurality of soap slivers; 2) providing a cementing agent including a mixture containing powdered bar soap and powdered talcum in proportions equal to between two-to-one and ten-to-one powdered bar soap to powdered talcum that has been mixed with sufficient water to form a paste; 3) applying a quantity of the cementing agent to an exterior surface of a first soap sliver of the plurality of soap slivers; 4) contacting a second soap sliver of the plurality of soap slivers to the cementing agent in a manner such that a least a portion of the quantity of cementing agent is pressed between the first and second soap slivers forming an agglomeration bar; 5) repeating steps 3 and 4 until all of the soap slivers in the plurality of soap slivers are pressed against a quantity of cementing agent in connection with the agglomeration bar; and 6) allowing the agglomeration bar to cure under ambient room temperatures for a period of time sufficient to allow the cementing agent to harden.

EXEMPLARY MODE FOR CARRYING OUT THE INVENTION

An exemplary process embodying the method of the invention is described hereinbelow to more clearly explain the advantages of the present method. The method includes the steps of: 1) accumulating the bar soap slivers from at least five bars of soap; 2) grinding the five slivers of soap accumulated in step 1 until a powder is achieved; 3) providing a quantity of powdered talcum equal to about one-half, by weight, of powdered soap; 4) mixing the powdered soap and powdered talcum until an even cementing mixture is achieved; 5) adding a sufficient quantity of water to the cementing mixture to create a cementing paste that will adhere to a mixing utensil; 6) applying a quantity of the cementing paste to an exterior surface of a first soap sliver of the remaining soap slivers; 7) contacting a second soap sliver of the remaining soap slivers to the cementing paste in a manner such that a least a portion of the quantity of cementing paste is pressed between the first and second soap slivers forming an agglomeration bar; 8) applying a quantity of the cementing agent to the agglomeration bar and pressing all of the remaining soap slivers against a quantity of cementing agent in connection with the agglomeration bar; and 9) allowing the agglomeration bar to cure under ambient room temperatures for a period of time sufficient to allow the cementing paste to harden. Practice of this process results in the production of a bar of sufficient size to conveniently utilize while bathing or showering. In addition, because the cementing agent contains only soap, talcum and water, the agglomeration bar may be used in the same manner as a conventional bar of soap.

It can also be seen from the preceding description that a method of forming a bar of soap from a plurality of soap bar slivers has been provided that does not require the use of a special holding vessel or press; that is easily learned and practiced successfully with a minimum of training; and that utilizes a cementing compound that does not interfere with or restrict the use of a finished bar of soap formed by practicing the method.

It is noted that the embodiment of the method of forming a bar of soap described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A method of forming a bar of soap comprising the steps of:

1) providing a plurality of soap slivers;

2) providing a cementing agent including a mixture containing powdered bar soap and powdered talcum in proportions equal to between two-to-one and ten-to-one powdered bar soap to powdered talcum that has been mixed with sufficient water to form a paste;

3) applying a quantity of said cementing agent to an exterior surface of a first soap sliver of said plurality of soap slivers;

4) contacting a second soap sliver of said plurality of soap slivers to said cementing agent in a manner such that a least a portion of said quantity of said cementing agent is pressed between said first and second soap slivers forming an agglomeration bar;

5) applying a qantity of said cementing agent to said agglomeration bar and pressing any remaining soap slivers of said plurality of soap slivers against said qantity of cementing agent in connection with said agglomeration bar; and 6) allowing said agglomeration bar to cure under ambient room temperatures for a period of time sufficient to allow said cementing agent to harden.

2. A method of forming a bar of soap comprising the steps of:

1)accumulating bar soap slivers from at least five bars of soap;

2) grinding said five slivers of soap accumulated in step 1 until a powder is achieved;

3) providing a quantity of powdered talcum equal to about one-half, by weight, of powdered soap;

4) mixing said powdered soap and powdered talcum until an even cementing mixture is achieved;

5) adding a sufficient quantity of water to said cementing mixture to create a cementing paste that will adhere to a mixing utensil;

6) using said cementing paste to cement additional bar soap slivers together to form an agglomeration bar and 7) allowing said agglomeration bar to cure under ambient room temperatures for a period of time sufficient to allow said cementing paste to harden.

* * * * *